US005409212A

United States Patent [19]

Arnett

[11] Patent Number: 5,409,212

[45] Date of Patent: Apr. 25, 1995

[54] COMBINATION BALL MARK REPAIR TOOL AND GOLF GREEN SLOPE INDICATOR

[76] Inventor: Harold B. Arnett, 1391 W. 800 South, Orem, Utah 84058

[21] Appl. No.: 284,187

[22] Filed: Aug. 2, 1994

[51] Int. Cl.[6] ..... A63B 57/00

[52] U.S. Cl. ..... 273/32 B; 273/32 H

[58] Field of Search ..... 273/32 R, 32 B, 32 H

[56] References Cited

U.S. PATENT DOCUMENTS

| | | | |
|---|---|---|---|
| 3,306,618 | 2/1967 | Liljequist | 273/162 |
| 3,751,819 | 8/1973 | Dixon | 33/389 |
| 3,870,299 | 3/1975 | Howe | 273/32 H |
| 4,984,790 | 1/1991 | Dowdy et al. | 273/32 B |
| 4,984,791 | 1/1991 | Labell | 273/32 H |
| 5,121,519 | 6/1992 | Haugom | 15/105 |
| 5,209,470 | 5/1993 | Cimaroli et al. | 273/32 H |
| 5,330,179 | 7/1994 | Hampel | 273/32 H |

*Primary Examiner*—George J. Marlo
*Attorney, Agent, or Firm*—Madson & Metcalf

[57] ABSTRACT

The invention provides a novel combination tool for the repair of ball marks on a golf green and for assisting a golfer in determining the slope of a golf green. The device is compact and easily capable of being carried in a golfer's pocket. The device comprises an elongated, thin body with opposite ends and a substantially planar bottom surface. Each of the opposite ends is equipped with two spade-like prongs, which are well-adapted for the repair of ball marks on a golf green. The device further comprises a frame for housing a bubble-type level, which is attached to the top surface of the device, and is capable of assisting a golfer in making a quick and accurate determination of the slope of a golf green.

17 Claims, 2 Drawing Sheets

COMBINATION BALL MARK REPAIR TOOL AND GOLF GREEN SLOPE INDICATOR

BACKGROUND

1. Field of the Invention

The present invention relates generally to the game of golf and, more specifically, to a combination golf tool that assists in repairing ball marks on golf greens and provides a means for measuring the slope of a green.

2. Technology Review

In the sport of golf, a golfer must perform a variety of tasks upon reaching the green of each golf hole. As an initial matter, any "ball mark" made upon the green by a golfer's golf ball should be repaired. A ball mark is made when a golf ball lands on a green. The resulting mark is typically a small depression corresponding to the shape of the ball or, in some cases, a shallow divot. The mark's size depends on a variety of factors, including the loft of the golf shot, the velocity of the ball on impact, the angle of the ball's flight on impact, and the amount of moisture in the green.

The ball mark thus creates a disturbance in the normally smooth surface of the green and produces a difficult and unpredictable obstacle for future putters. In addition, if the ball mark is not repaired, the grass within the depression will likely die and leave an unsightly brown spot, or divot, in the green. In order to be courteous to future golfers, and in order to prevent the unsightly brown spots in the greens, most golf courses require, and continually remind, golfers to repair their ball marks.

Golfers have in the past resorted to a variety of different devices to assist them in the repair of ball marks in the green. A golf tee or a single house key or car key have often been used for this purpose. Either of these devices will require a number of separate insertions around the periphery of the ball mark followed by a prying motion to lift the depressed grass so that it becomes level with the rest of the green. A number of different repair tools have also been used as an alternative to these rather crude methods. As examples, U.S. Pat. Nos. 3,185,483, 4,984,790, and 5,121,519 show various types of repair tools that have been developed to assist the golfer in the repair of ball marks. Typically, such devices employ a two or three prong spade-like digging portion at one end. These two or three pronged tools represent an improvement over the golf tee or car key methods, enabling a quicker and more effective repair of ball marks.

A second task that a golfer must perform upon reaching the green is to determine the slope of the green between the golfer's golf ball and the cup. In order for a golfer to accurately putt the ball into the cup, the golfer must first determine which direction the green slopes, or "breaks," so that the slope can be properly accounted for when stroking the putt. Failure to accurately determine the slope will result in a putt that misses its intended mark, often by a considerable distance.

Most golfers rely on a simple visual inspection, by standing behind the golf ball and looking toward the cup, in order to estimate the slope of the green. Determining the slope of the green by visual inspection is a difficult process, often fooling even the most experienced golfers.

Various devices have been tried before in order to assist the golfer in determining the slope of a green.

Among these devices are certain leveling instruments which are either attached to a putter, held in the hand, or, in one embodiment, incorporated into a separate device adapted to roll over the surface of the green. None of these existing devices, however, provide a quick and efficient tool which is capable of being carried in the golfer's pocket and used in such a manner that it will not unnecessarily slow the play of the game.

U.S. Pat. Nos. 3,306,618 and 5,209,470 are two examples of existing devices which utilize a leveling instrument attached to a putter. Both devices incorporate a bubble-type level within the head of a putter, thus enabling the golfer to determine the slope of a green by observing the bubble level when the putter head rests squarely on the green. The golfer may effectively measure the slope of the green at any of a number of positions between the golf ball and the cup by resting the bottom surface of the putter head flushly on the surface of the green and observing the location of the bubble with respect to the index mark on the level.

While the devices incorporating a bubble level within the head of a putter teach a simple and effective means for determining the slope of a green, there are certain disadvantages associated with such devices. One significant disadvantage is that it requires the golfer to purchase a new putter. This is not only unappealing from a cost standpoint, but also unappealing to the many golfers who have grown accustomed to their own putter, have developed a comfortable "feel" for their own putter through years of continuous use, and do not wish to switch to a different model of putter.

Another disadvantage with devices which incorporate a bubble level within the head of a putter is that it requires a putter with a planar bottom surface. If the bottom surface of the putter curves upwards at either the toe or heel end to give a convex nature to the bottom surface, the device's effectiveness as a leveling instrument is diminished. Many popular putters have a convex bottom surface, and many golfers prefer such a design as it enables the golfer to angle the putter so that either the toe of the putter head or the heel of the putter head is higher in relation to the rest of the putter head. This is simply a matter of individual preference. A golfer who prefers to angle the putter head when putting such that the heel of the putter is lower than the toe, for example, would not prefer a putter with a planar bottom surface. Thus, even if cost were not a concern, many golfers may still not prefer a putter designed for incorporating a leveling device. This is because the planar bottom surface required for such a device may not suit the individual's putting style.

Other types of leveling instruments have also been used as an aid in measuring the slope of a golf green. U.S. Pat. No. 4,984,791 teaches the use of a hand held device consisting of a hollow frame housing two right angularly related bubble levels, with each level having an index mark and a sighting rod. The device is used by holding the device at eye level and visually aligning the sighting rod with the golf ball and the cup while maintaining the frame in a plane at right angles to the line of sight. Thereafter, the axis of the first level is angularly adjusted into parallel registry with any transverse slope in the green and the position of the bubble of the first level is noted in relation to the index mark. By noting the position of each of the two bubbles while going through these sighting maneuvers, a golfer should be able to determine the slope of the green in a right or left direction as well as in an up or down direction between the golf ball and the cup.

The obvious disadvantage with such a device is that it is complicated. Further, because a number of complicated adjustments and sightings, then readjustments and resightings, are required, the method is time-consuming and slows the play of the game. Whenever such a method requires a number of complicated and time-consuming steps, the net result will often be that the device will remain in the pocket, unused.

Yet another device that uses a bubble-type level as an aid in measuring the slope of a golf green is taught by U.S. Pat. No. 3,751,819. This device incorporates a bubble-type level supported on a wheeled structure secured to a handle. Its size makes it appropriate to carry the device in a golf bag, similar to carrying an additional golf club. To determine the slope of a green, the golfer grasps the device by the handle and wheels it across the green between the golfer's ball and the cup, all the while observing the position of the bubble level in relation to a central index mark.

This device also suffers a number of disadvantages. Initially, the size of the device is such that it can not be carried within a golfer's pocket. Instead, the device must be carried in a golf bag, much like an additional club. As a result, use of the device is rather awkward, requiring a golfer to carry, in addition to a putter, this additional device each time the golfer reaches a green. In addition, use of the device is time-consuming. Groups of golfers playing behind a golfer utilizing this device would become understandably impatient, waiting as the golfer, prior to each putt, walks back and forth between the ball and the cup trying to read the bubble level.

It would be an advancement in the art, then, if one could provide a simple device, which is quick and easy to use, and which is of a size capable of being carried in a pocket, which could assist a golfer in determining the slope of a green. It would be a further improvement if such a device was also adapted for the repair of ball marks on the green, such that once the ball mark was repaired, a golfer could then make a quick determination of the green's slope without having to utilize a separate device.

SUMMARY OF THE INVENTION

The present invention provides a combination tool for repairing ball marks and determining the slope of a golf green. The combination tool is compact, lightweight, and easily carried in a golfer's pocket. Significantly, both of the primary functions of the tool, ball mark repair and golf green slope indicator, relate to tasks a golfer must (or should) perform upon reaching the green of each golf hole. Thus, the tool provides quick and effective means to accomplish both tasks, and provides these in a single, compact device, a need heretofore unfulfilled in the art.

The present device includes an elongated, thin body having opposite ends and a frame for housing a bubble-type level. The frame for housing the level is preferentially attached to the upper surface of the body and located approximately midway between the opposite ends. Importantly, the bottom surface of the body, and the device as a whole, is planar. This allows the bubble level to function as a golf green slope indicator when the device is resting flush on the green's surface.

The overall length of the device should be between approximately 3 inches and 6 inches. This length best serves the dual purposes of providing a device of sufficient length to function as an effective leveling device, and at the same time, providing a device compact enough to fit easily within a golfer's pocket. It may be appreciated that as the device's length becomes shorter and shorter, its effectiveness as a leveling instrument will diminish. In the presently preferred embodiment, the device is approximately 4½ inches in length.

The two opposite ends of the body are each adapted for use as a ball mark repair tool. In the presently preferred embodiment, both ends comprise two spade-like prongs which are symmetrical in shape and well-adapted to perform a digging function. By grasping the device at one of its ends, a golfer may use the opposite end as a ball mark repair tool by inserting the prongs into the green's surface at the periphery of the ball mark and applying an upward, prying force to the depressed turf. In this manner, the depressed turf may be raised to the level of the surrounding green, thus restoring the normally smooth surface of the green. In the presently preferred embodiment, either end of the device may be used for grasping while the opposite end is used to repair a ball mark.

It is presently preferred that the body be made from metal. This is to ensure that the body is of sufficient strength that it will not bend or break when subjected to the prying-type forces used when repairing a ball mark. Other types of materials, such as plastic or wood, could also conceivably be used to form the body of the device.

Other embodiments of the present invention can be imagined which do not depart from the overall scope of the invention. A ball mark repair tool consisting of three or more prongs, rather than two, for example, could be substituted at either or both of the opposite ends of the device without changing the overall nature of the invention. As another example, while the presently preferred embodiment envisions prongs that are symmetrical in shape, one can also imagine a ball mark repair tool wherein the prongs are not symmetrical in shape. In addition, a device wherein only one of the opposite ends comprises a ball mark repair tool can also be imagined. The other end could take any one of many possible design forms without changing the overall nature of the invention.

In any of these alternative embodiments, however, it is significant that the bottom surface of the prongs, along with the bottom surface of the device as a whole, must be substantially planar in nature. Without a planar bottom surface, the device will be ineffective as a leveling instrument.

The present invention further comprises a frame adapted for housing a bubble-type level. The frame should be attached to the top surface of the body in such a manner that the level can be easily observed when the device is resting flush on the green's surface. In addition, the frame should be attached to the body in such a manner that the overall planar nature of the device's bottom surface is undisturbed. It is presently preferred to attach the frame to the body by a snapping mechanism, wherein the frame engages a small side wing on the side surface of the body. Alternative methods of attachment can be imagined, such as directly affixing the frame to the top surface of the body, by glue or otherwise, which do not depart from the overall scope of the invention.

The frame houses a bubble-type level which is suitable for indicating the slope of a golf green. When the device is resting in a substantially level position, the bubble will be centered over a central index mark inscribed on the bubble level. When the device is not resting in a level position, however, the direction of slope will be indicated by the position of the bubble. If the right end of the device is relatively higher than the left end, the bubble will be positioned to the right of the central index mark. Conversely, if the left end of the device is relatively higher than the right end, the bubble will be positioned to the left of the central index mark.

A golfer can quickly and easily measure the slope of a golf green at any point by using this devise. By placing the device on the green at any point between the golf ball and the cup such that the longitudinal axis of the device is perpendicular to the line from the ball to the cup, a golfer can determine the right-to-left, or left-to-right, slope of the green. Then by turning the device so that the longitudinal axis of the device is parallel to the line from the ball to the cup, a golfer can determine whether the green slopes up or down between the ball and the cup.

It is presently preferred to incorporate a single, elongated bubble-type level as the leveling instrument utilized in the device. The single, elongated bubble level is oriented within the frame such that the longitudinal axis of the bubble level is oriented lengthwise between the opposite ends of the device's body, and the longitudinal axis is parallel to the bottom surface of the device.

Other types of leveling instruments could be incorporated without departing from the spirit of the invention. For example, one can imagine a leveling instrument consisting of a pair of right angular related bubble levels, so that a golfer can determine both the right or left as well as the up or down slope of a green at a single time, without having to reposition the device. Further, one can imagine a dome-shaped bubble level with a series of concentric index circles being utilized. This type of bubble level would similarly allow a golfer to determine both the right or left slope of a green as well the up or down slope of a green in a single reading.

The advantages of this unique device can readily be appreciated when one considers the various tasks a golfer must perform upon reaching the green of a golf hole. As an initial matter, it is often the case that a golfer's golf ball has left a ball mark on the green that will need to be repaired prior to putting the ball. Alternatively, or perhaps additionally, it will often be the case that an unrepaired ball mark from a previous, uncourteous golfer lies between a golfer's ball and the cup. This ball mark will also need to be repaired prior to putting the ball. The present invention provides a handy, useful repair tool which facilitates the repair of these ball marks.

Once this has been accomplished, a golfer must then focus on putting the golf ball into the cup. In order to do this, it will be necessary for the golfer to properly determine the slope of the green between the ball and the cup. Since making this determination is often difficult by visual inspection alone, it would be advantageous to have a device, readily available, which could quickly and effectively determine the slope of the green. The present invention provides such a device. Importantly, the device is readily available, often already in hand from repairing a ball mark. Thus, a golfer can quickly and easily determine the slope of the green with the same tool the golfer has just used to repair a ball mark. Further, this determination can be made while the golfer is still kneeling on the golf green. A golfer simply allows the device to rest on the green's surface for a moment and a determination can easily be made. No extra trip to the golf bag or search through the pockets for a separate device is required. Also significantly, no difficult computations or sightings are required. The task can be accomplished swiftly and easily without any disruption in the play of the game.

The invention accordingly comprises the features of construction and combination of elements as exemplified in the following detailed description, and the scope of the invention will be indicated in the claims.

DETAILED DESCRIPTION OF THE INVENTION

Figure 1:
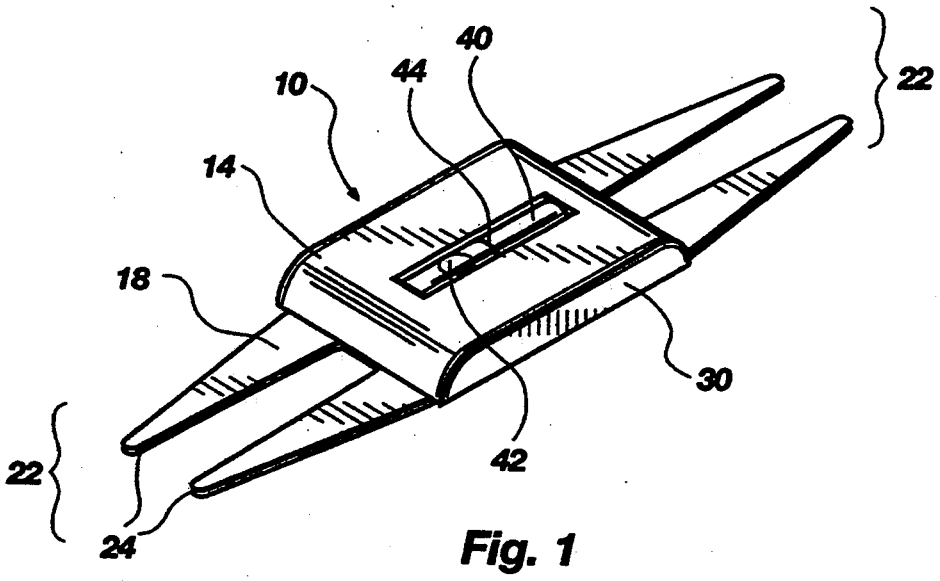
FIG. 1 is a perspective view of the novel combination ball mark repair tool and golf green slope indicator.
Figure 2:
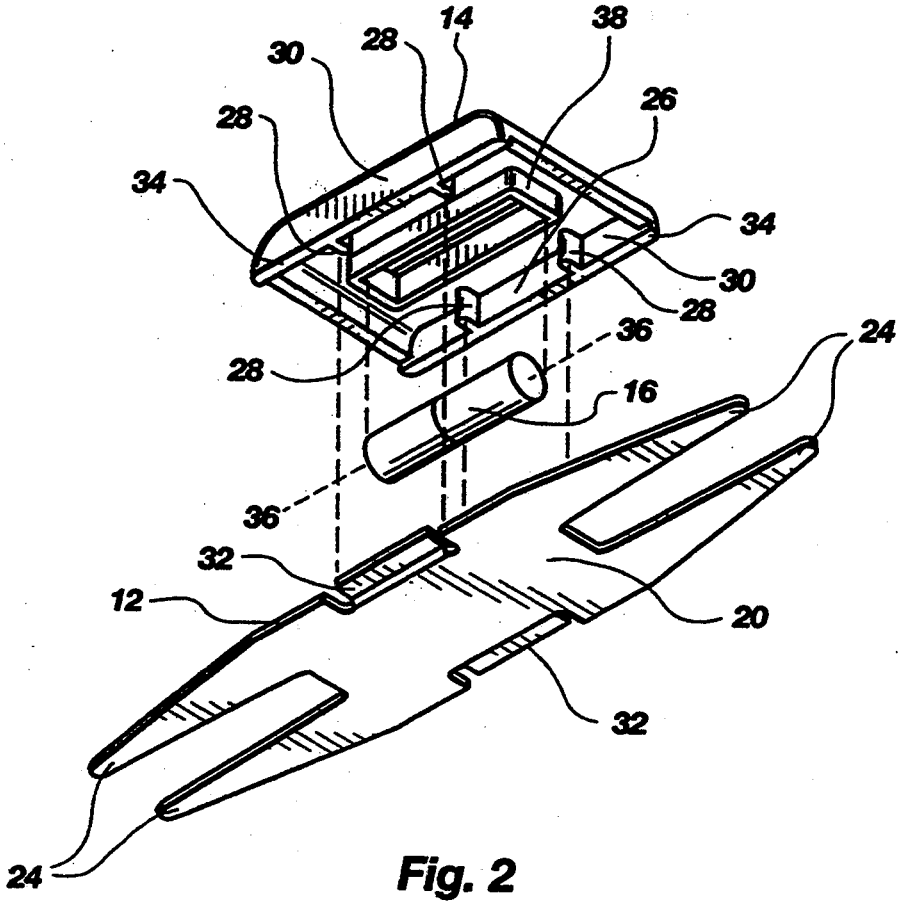
FIG. 2 is an exploded perspective view of the same device.

Referring to FIGS. 1 and 2, a combination ball mark repair tool and golf green slope indicator is generally indicated at 10, and referred to generally as "the device" hereinafter. The device comprises an elongated, thin body 12 and a frame 14 adapted for housing a bubble-type level 16. The elongated, thin body 12 has a top surface 18 and a bottom surface 20 and opposite ends 22. The bottom surface 20 is substantially planar.

In a presently preferred embodiment of the invention, each of the opposite ends 22 of the body 12 comprises two spade-like prongs 24 which are adapted to be inserted in a golf green under a ball mark. The prongs 24 are symmetrical in shape, extend outward from the body 12, and have a bottom surface on each prong 24 that is coplanar with the bottom surface 20 of the body 12.

Those skilled in the art will appreciate that the prongs 24 may also be asymmetrical in shape. That is, one prong may be essentially flat and the other rounded, or one prong may be longer than the other. It is also within the scope of the present invention to have more than two prongs 24 on either one or both of the opposite ends 22. When more than two prongs are present, it is preferred that at least two prongs have a bottom surface substantially coplanar with the bottom surface 20 of the body 12. Additional prongs may optionally be located in or above the plane defined by the bottom surface 20 of the body 12.

The frame 14 is attached to the top surface of the body 18 so that the planar nature of the bottom surface 20 is substantially retained. It is presently preferred to attach the frame 14 to the body 12 by means of a snapping mechanism, although other attachment techniques, such as gluing or welding, may also be used. One possible configuration for snap attachment of the frame 14 to the body 12 is illustrated in FIG. 2. The frame 14 provides a pocket 26 between a pair of pillars 28 on each of the opposing inside surfaces of side walls 30. The body 12 has a pair of side wings 32 configured to engage corresponding pockets 26 of frame 14. Once the frame 14 is engaged, the bottom edges 34 of each of the side walls 30 of the frame 14 are substantially coplanar with the bottom surface 20 of the body 12. It is presently preferred to attach the frame 14 to the body 12 at approximately the midway point between the opposite ends 22.

The frame 14 is adapted for housing a bubble-type level 16. In the currently preferred embodiment of the invention, a single elongated bubble level 16 is utilized, wherein the longitudinal axis 36 defined by the bubble level is oriented lengthwise between the opposite ends 22 of the elongated body 12 and substantially parallel to the bottom surface of the body 20. The bubble level 16 is housed within the frame 14 by means of an inner sleeve 38 whose inner dimensions correspond substantially to the length and width of the bubble level 16 so that the bubble level 16 will fit snugly within the inner sleeve 38. The bubble level 16 can be viewed through a transparent window 40 which is located on the top surface of the frame 14, directly over and corresponding to the inner sleeve 38. The transparent window 40 is preferentially open to allow direct viewing of the bubble level 16. Alternatively, the transparent window 40 may be made of glass or a clear plastic.

The bubble level 16 has a bubble 42 which will be positioned so that the center of the bubble 42 will be directly beneath a central index mark 44 inscribed on the transparent window 40 when the device 10 is resting in a substantially level position. When the device 10 is resting on a surface which is sloped, the direction of slope will be indicated by the position of the bubble 42 in relation to the central index mark 44. When the left end of the device 10 is relatively higher than the right end, this will be indicated by the bubble's position left of the central index mark 44. Conversely, when the right end of the device 10 is relatively higher than the left end, the bubble's 42 position will be to the right of the central index mark 44.

A golfer may determine, quickly and effectively, the slope of a golf green at any particular point on the green by resting the device 10 so that the bottom surface 20 of the body is flush with the green's surface, and then observing the position of the bubble 42 in relation to the central index mark 44. No slope, or a flat green, is indicated by the bubble 42 centered beneath the central index mark 44.

Figure 3:
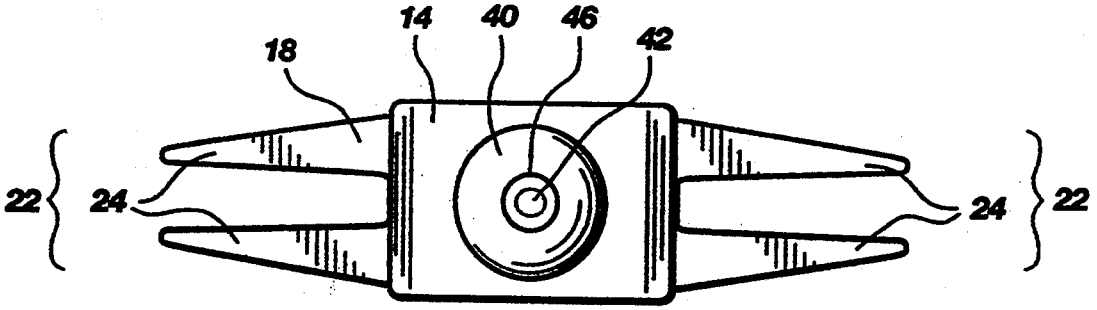
FIG. 3 is a top view of an alternative embodiment of the present invention.

FIG. 3 represents an alternative embodiment of the present invention. In this embodiment, a dome shaped bubble level is used rather than an elongated bubble level. A circular index mark 46, rather than a single linear index mark 44, is inscribed on the bubble level. When the device 10 is resting in a substantially level position, the bubble will be centered within the circular index mark 46. When the device 10 is resting on a surface that is sloped, this will be indicated by the bubble's position outside of the circular index mark 46. The exact position of the bubble will depend on the direction of the slope. A plurality of concentric circles may be used, rather than a single circular index mark 46, to indicate the magnitude of the slope.

Figure 4:
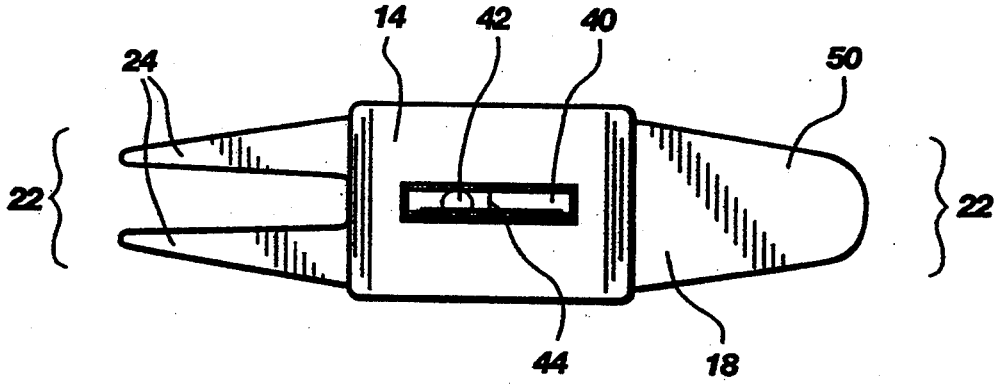
FIG. 4 is a top view of an additional alternative embodiment of the present invention.
Figure 5:
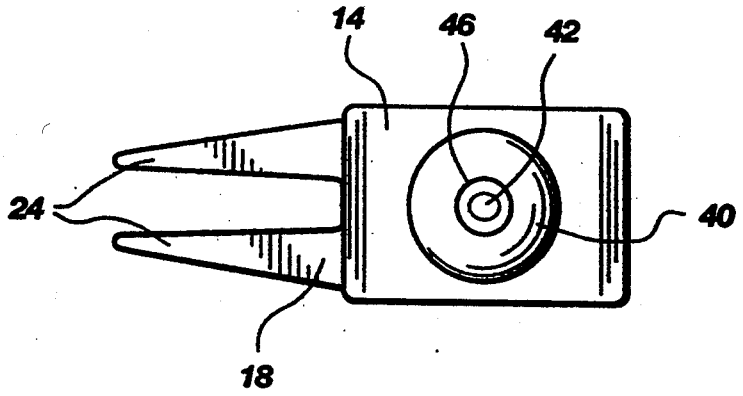
FIG. 5 is a top view of an additional alternative embodiment of the present invention.

FIG. 4 represents an additional alternative embodiment of the present invention. In this embodiment, only one of the opposite ends 22 comprises a ball mark repair tool. The other opposite end 50 is not equipped with prongs and, therefore, functions more as a handle or gripping portion when the pronged end 24 is being used to fix a ball mark. Opposite end 50 also adds sufficient length to device 10 so that an accurate measurement of the slope is possible.

From the foregoing, it will be appreciated that the present invention provides a simple device, which is quick and easy to use, is of a size capable of being carried in a pocket, and can assist a golfer in determining the slope of a green. The invention is further adapted for the repair of ball marks on the green, so that once a ball mark is repaired, a golfer can then make a quick determination of the green's slope without having to utilize a separate device.

The present invention may be embodied in other specific forms without departing from its essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The claimed invention is:

1. A portable device of a size capable of being carried in a golfer's pocket for repairing ball marks in a golf green and for measuring the slope of the green comprising:

an elongated body having top and bottom surfaces and opposite ends, wherein the bottom surface is substantially planar for resting flush with the green's surface and at least one of the opposite ends comprises at least two prongs adapted to be inserted in the golf green under a ball mark, said prongs having a bottom surface substantially coplanar with the bottom surface of the body; and a housing containing at least one bubble-type level capable of indicating the slope of a golf green attached to the body.

2. The device as set forth in claim 1, in which both opposite ends of the body comprise at least two prongs adapted to be inserted in the golf green under a ball mark, said prongs extending outwardly from the body, and having a bottom surface substantially coplanar with the bottom surface of the body.

3. The device as set forth in claim 1, in which both opposite ends of the body comprise exactly two prongs adapted to be inserted in the ground under a ball mark, said prongs extending outwardly from the body, and having a bottom surface substantially coplanar with the bottom surface of the body.

4. The device as set forth in claim 3, in which said prongs are symmetrical in shape.

5. The device as set forth in claim 1, in which the housing is located midway along the elongated body of the device, between the opposite ends.

6. The device as set forth in claim 1, in which the bubble-type level capable of indicating the slope of a golf green comprises a single elongated bubble-type level which defines a longitudinal axis, with the longitudinal axis thereof oriented lengthwise between the opposite ends of the elongated body and substantially parallel to the bottom surface of the elongated body, said bubble-type level having a bubble normally centered along at least one index mark when said device is resting in a substantially level plane.

7. The device as set forth in claim 1, in which the bubble-type level capable of indicating the slope of a golf green comprises a pair of right angular related first and second bubble levels which are coplanar, the first bubble level with longitudinal axis thereof oriented lengthwise between the opposite ends of the elongated body and substantially parallel to the bottom surface of the elongated body, and the second bubble level with longitudinal axis thereof perpendicular to the axis of the first bubble level and parallel to the bottom surface of the elongated body, each said bubble level having a bubble normally centered along at least one index mark when the device is resting in a substantially level position.

8. The device as set forth in claim 1, in which the bubble-type level capable of indicating the slope of a golf green comprises a curved, transparent, dome shaped bubble level having a bubble normally centered within an index circle when said device is resting in a substantially level position.

9. The device as set forth in claim 8, in which the dome shaped bubble level has a bubble normally centered within a central most index circle in a series of concentric index circles when said device is resting in a substantially level position.

10. A portable device of a size capable of being carried in a golfer's pocket for repairing ball marks in a golf green and for measuring the slope of the green comprising:

an elongated, thin body having top and bottom surfaces and opposite ends, wherein the bottom surface is substantially planar for resting flush with the green's surface and both opposite ends comprise at least two prongs adapted to be inserted in the golf green under a ball mark, said prongs extending outwardly from the body, and having a bottom surface substantially coplanar with the bottom surface of the body; and a containing housing a bubble-type level capable of indicating the slope of a golf green, said housing attached to the body essentially midway along the elongated body of the device, between the opposite ends, wherein said bubble-type level comprises a single elongated bubble-type level which defines a longitudinal axis, with the longitudinal axis thereof oriented lengthwise between the opposite ends of the elongated body and substantially parallel to the bottom surface of the elongated body, said bubble-type level having a bubble normally centered along at least one index mark when said device is resting in a substantially level plane.

11. The device as set forth in claim 10, in which both opposite ends of the body comprise exactly two prongs adapted to be inserted in the ground under a ball mark, said prongs extending outwardly from the body, and having a bottom surface substantially coplanar with the bottom surface of the body.

12. The device as set forth in claim 11, in which the prongs are symmetrical in shape.

13. The device as set forth in claim 10, in which the housing is attached to the top surface of the body.

14. The device as set forth in claim 13, in which the housing is glued to the top surface of the body.

15. The device as set forth in claim 10, in which the elongated, thin body further has side surfaces between the top and bottom surfaces, and the housing is attached to at least one of the side surfaces.

16. A portable device of a size capable of being carried in a golfer's pocket for repairing ball marks in a golf green and for measuring the slope of the green comprising:

an elongated, thin body having top and bottom surfaces and opposite ends, wherein the bottom surface is substantially planar for resting flush with the green's surface and one of the opposite ends comprises at least two prongs adapted to be inserted in the golf green under a ball mark, said prongs extending outwardly from the body, and having a bottom surface substantially coplanar with the bottom surface of the body; and a housing containing a bubble-type level capable of indicating the slope of a golf green, said housing attached to the body at the end of the body opposite the end comprising the prongs, wherein said bubble-type level comprises a curved, transparent, dome shaped bubble level having a bubble normally centered within an index circle when said device is resting in a substantially level position.

17. The device as set forth in claim 16, in which the dome shaped bubble level has a bubble normally centered within a central most index circle in a series of concentric index circles when said device is resting in a substantially level position.

* * * * *